US005904308A

United States Patent [19]

Schnell

[11] Patent Number: 5,904,308

[45] **Date of Patent: *May 18, 1999**

[54] DEVICE AND TREATMENT MACHINE FOR THE MECHANICAL TREATMENT OF HIGH-CONSISTENCY FIBROUS MATERIAL

[75] Inventor: Hans Schnell, Mengen, Germany

[73] Assignee: Voith Sulzer Papiertechnik Patent GmbH, Ravensburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/747,494

[22] Filed: Nov. 12, 1996

[30] Foreign Application Priority Data

Nov. 10, 1995 [DE] Germany ..... 195 41 891

[51] Int. Cl.[6] ..... B02C 7/02; B02C 7/12

[52] U.S. Cl. ..... 241/188.2; 241/261.3; 241/297

[58] Field of Search ..... 241/261, 261.2, 241/261.3, 297, 188.1, 188.2, 186.5

[56] References Cited

U.S. PATENT DOCUMENTS

| | | | |
|---|---|---|---|
| 2,627,394 | 2/1953 | Spencer . | |
| 3,194,540 | 7/1965 | Hager . | |
| 3,195,867 | 7/1965 | Mould, Jr. . | |
| 4,061,283 | 12/1977 | Kahmann | 241/261.3 |
| 4,383,650 | 5/1983 | Contal et al. | 241/66 |
| 4,431,482 | 2/1984 | Heinbockel et al. . | |
| 4,522,342 | 6/1985 | Muschenborn et al. . | |
| 5,042,726 | 8/1991 | Reinhall | 241/28 |
| 5,509,610 | 4/1996 | Gibbons et al. | 241/37 |

FOREIGN PATENT DOCUMENTS

| | | |
|---|---|---|
| 52052 | 11/1966 | Germany . |
| 1254953 | 11/1967 | Germany . |
| 2826553 | 1/1980 | Germany . |
| 3047013 | 7/1982 | Germany . |

*Primary Examiner*—John M. Husar
*Attorney, Agent, or Firm*—Greenblum & Bernstein, P.L.C.

[57] ABSTRACT

Treatment tools for the mechanical treatment of high-consistency fibrous material, and preferably for dispersing waste paper. The treatment tools are provided with teeth and are moved past one another with tight spacing so that the fibrous material disposed between treatment tool may be subjected to high shearing forces. Because of the intense loading of the teeth, the teeth may be arranged together in groups. The groups utilize at least one intermediary piece positioned between adjacent teeth to form at least a corresponding closed gap between the adjacent teeth of the treatment tools. As a result, a higher mechanical strength of the teeth is achieved and a large through flow area is offered for the material to be treated.

28 Claims, 3 Drawing Sheets

DEVICE AND TREATMENT MACHINE FOR THE MECHANICAL TREATMENT OF HIGH-CONSISTENCY FIBROUS MATERIAL

CROSS-REFERENCE OF RELATED APPLICATIONS

The present invention claims the priority under 35 U.S.C. § 119 of German Patent Application No. 195 41 891.3 filed on Nov. 10, 1995, the disclosure of which is expressly incorporated by reference herein in its entirety.

BACKGROUND OF THE INVENTION

1. Field of the Invention

The present invention relates to a device for the mechanical treatment of high-consistency fibrous material that may include two treatment tools mounted for relative movement therebetween. The treatment tools may include a plurality of coaxially arranged rows of raised teeth, the rows of teeth for each treatment tool being received in a corresponding space in the other treatment tool. The teeth in each coaxially arranged row may be interconnected by intermediary pieces positioned to form at least a closed gap.

2. Discussion of the Background Information

A treatment device for mechanical treatment of high-consistency fibrous material has been disclosed, for example, in German Patent No. 30 47 013, the disclosure of which is incorporated by reference herein in its entirety. This device, which is suited for dispersing waste paper, is used to intensively process the material in a mechanical and thermal fashion so that unwanted materials contained therein can be removed from the fibers, ground, and/or brought below the limit of visibility. In general, with devices for mechanical treatment of high-consistency fibrous material, the fibrous material is not processed in a suspension that can be pumped, but rather in the form of a doughy or crumbly high-consistency material, preferably with a dry content between 20 and 40%. In this manner, considerably higher shearing forces can be transmitted to the fibrous material, without a significant change in fiber length being correspondingly produced. In many cases, the action of the mechanical treatment is further reinforced by heat, e.g., by setting a fibrous material temperature of 90° C. or higher.

As a result of the high consistency that the fibrous material has during treatment, an intensive mechanical treatment is possible, even though the teeth of the treatment tools that move in relation to one another do not touch, but rather move past one another at a spacing of approx. 1 mm or more. In the process, considerable forces are exerted on the teeth, in particular at the foot of the tooth. Due to lever action, in addition to the shearing forces on the teeth, the tooth foot is engaged by a high moment that rises with increasing tooth height. Further, higher teeth are advantageous since the available through flow cross section is essentially proportional to tooth height. This is why, using one device, a correspondingly greater quantity of material can be treated in the same amount of time with equally high intensity. With larger machining units, a higher economy can almost always be achieved with regard to investment and operational costs.

For prior art devices for mechanical treatment of high-consistency fibrous material, tooth heights that can be achieved in the prior art depend on the manufacturing process. Thus there are cast arcs, which are assembled by being placed against one another into a closed, annular rotor set or stator set. For technical casting and forming reasons, with components of this kind produced for example using the sand is casting process, the gap width and tooth width cannot fall below 6 mm, and the tooth height mostly is not permitted to be more than 30 mm. Devices which are produced in a process of this kind can only have a comparatively low material hardness. The other working process is based on closed individual rings into which the gaps must be milled. These rings are assembled in concentric disposition into a complete rotor set or stator set. Because of the milling process, the gaps can be intrinsically smaller than in casting, but limitations arise due to strength requirements. Nevertheless, milled set rings can be produced with higher teeth than if they are cast. The high manufacture costs of milling, though, are disadvantageous.

SUMMARY OF THE INVENTION

The object of the invention, therefore, is to produce a device for the mechanical treatment of high-consistency fibrous material with which it is possible to process a greater throughput quantity than before while maintaining or improving the treatment action.

Accordingly, the present invention may be directed to a device for mechanical treatment of high-consistency fibrous material, with at least two treatment tools that can be moved in relation to each other. The treatment tools may include a rotationally symmetrical base body and may be disposed coaxial to each other, and have teeth disposed in annular rows concentric to the centers of the treatment tools and have annular empty spaces between the rows of teeth. Gaps may be disposed between the teeth and form clear cross sections which fibrous material to be treated can flow through. The treatment tools may be positioned so that at least one row of teeth of one treatment tool reaches into an annular empty space of another treatment tool. The treatment tool may also include a closed gap formed between adjacent teeth in at least one row, the closed gap enabling fibrous material flow therethrough.

In accordance with another feature of the present invention, the closed gap may include an axial length between approximately 40 and 150 mm.

In accordance with still another feature of the present invention, the gaps may include a circumferential width between approximately 5 and 30 mm.

In accordance with yet another feature of the present invention, the closed gap may include an axial length and a circumferential width, the axial length being at least six times the circumferential width.

In accordance with a further feature of the present invention, the connecting device may include an intermediary piece rigidly connected to respective tips of the adjacent teeth.

In accordance with a still further feature of the present invention, the connecting device may include an intermediary piece disposed between the adjacent teeth to form the closed gap and an open-ended gap.

In accordance with yet another feature of the present invention, the closed gap may be approximately equal to the open-ended gap.

In accordance with still another feature of the present invention, the connecting device may include an axial height between approximately 4 and 20 mm.

In accordance with another feature of the present the rotationally symmetrical base body may contain a plurality of concentric rows of teeth disposed radial to one another and two adjacent treatment tools, which can be moved in relation to each other, disposed axially adjacent to each other.

In accordance with still another feature of the present invention, in adjacent rows of teeth of complementary treatment tools, the intermediary piece of one treatment tool may be disposed radially adjacent the intermediary piece of the complementary treatment tool.

In accordance with a further feature of the present invention, the connecting member may include an intermediary piece for connecting each tooth in said row.

In accordance with a still further feature of the present invention, each tooth may include a radial tooth width and the connecting member may include an intermediary piece having a radial width less than the radial tooth width.

In accordance with yet another feature of the present invention, the at least two treatment tools may include one of individual segments of a circle and of a ring.

In accordance with another feature of the present invention, the at least two treatment tools may be produced in one of a casting and an injection process.

In accordance with still another feature of the present invention, the device may be utilized in combination with a treatment machine. The treatment machine may include a housing, essentially encompassing the first and second treatment tools, with at least one supply opening and at least one outlet opening. At the supply opening, the treatment machine may include a feed device that forms plugs and supplies a high-consistency fibrous material to be treated and that conveys the high-consistency fibrous material between the relatively rotating treatment tools.

In accordance with another feature of the present invention, the outlet opening may include a fall shaft for the treated high-consistency fibrous material.

In accordance with still another feature of the present invention, the treatment tool may include devices positioned upstream from the treatment tools for adding water for the treated, high-consistency fibrous material.

The present invention may also be directed a device for mechanically treating high-consistency fibrous material. The device may include first and second treatment tools mounted for relative rotation. Each treatment tool may include a plurality of annular toothed rows including a plurality of teeth and an adjacent gap between each of the plurality of teeth, and at least one intermediary piece connecting adjacent teeth to form a closed gap that enables the fibrous material to move through the device.

In accordance with a further feature of the present invention, each of the plurality of teeth may include a tooth foot positioned adjacent a corresponding treatment tool and a tooth edge positioned opposite the tooth foot.

In accordance with still another feature of the present invention, the at least one intermediary piece may be positioned between the tooth edges of adjacent teeth.

In accordance with another feature of the present invention, the intermediary device may include a single piece that connects each adjacent tooth in at least one of the plurality of annular rows.

In accordance with yet another feature of the present invention, the intermediary piece may also form an open-ended gap.

In accordance with still another feature of the present invention, the at least one intermediary piece may be positioned between the tooth edges and the tooth feet of the adjacent teeth.

In accordance with another feature of the present invention, each of the first and second treatment tools may further include an annular space between each adjacent annular row. The treatment tools may be mounted such that each of the plurality of annular rows of the first treatment tool extend into respective annular spaces of the second treatment tool and that each of the plurality of annular rows of the second treatment tool extend into respective annular spaces of the first treatment tool.

In accordance with a still further feature of the present invention, the at least one intermediary piece may include a first intermediary piece between the tooth edges and the tooth feet of adjacent teeth of the first treatment tool and a second intermediary piece between the tooth edges and the tooth feet of adjacent teeth of the second treatment tool.

In accordance with a further feature of the present invention, the first and second intermediary pieces may be rotatable within a same plane between the first and second treatment tools.

In accordance with still another feature of the present invention, each of the plurality of teeth may include a radial tooth width and the intermediary pieces may include a radial piece width.

In accordance with yet another feature of the present invention, the radial tooth width may be greater than the radial piece width.

In accordance with the present invention, the through flow cross sections which are between the teeth and which are available to the fibrous material can be increased without risking an overload stress on the tooth feet. As a result of its rigidity, the connecting piece positioned between adjacent teeth exerts a load moment, which increases the resistance of the teeth to bending. Further, peak shearing force values may be distributed onto a number of teeth, thus reducing the damaging effects of these forces.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
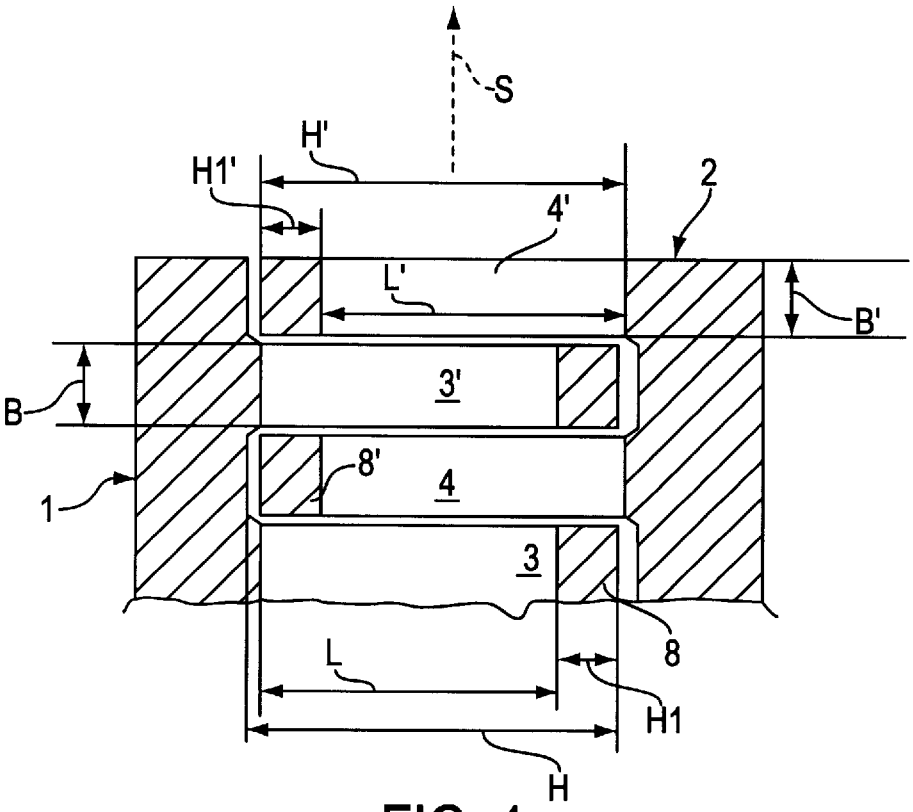
FIG. 1 shows a section through a side view of the essential part of the device according to the invention.

FIG. 1 shows two complementary treatment tools 1 and 2 which can be moved in relation to each other and which engage each other so that they can cooperate. For example, treatment tool 1 can be affiliated with a rotor and treatment tool 2 can be affiliated with a stator. At the same time, therefore, in the case represented here, the treatment tool, viewed in the flow direction, is radially closed off on the outside by a stator. It is easily conceivable that the last ring from a radial standpoint is a rotor ring, by means of which, for example, the material would be centrifuged out from the treatment apparatus. The selected representation in the form of a sectional side view, shows that the teeth 3, 4, 3', 4' affiliated with different treatment tools alternate from the inside to the outside, radially speaking. Their height is indicated as H or H'. The direction of the material flow, radially outward from the inside, is indicated by arrow S.

Figure 2:
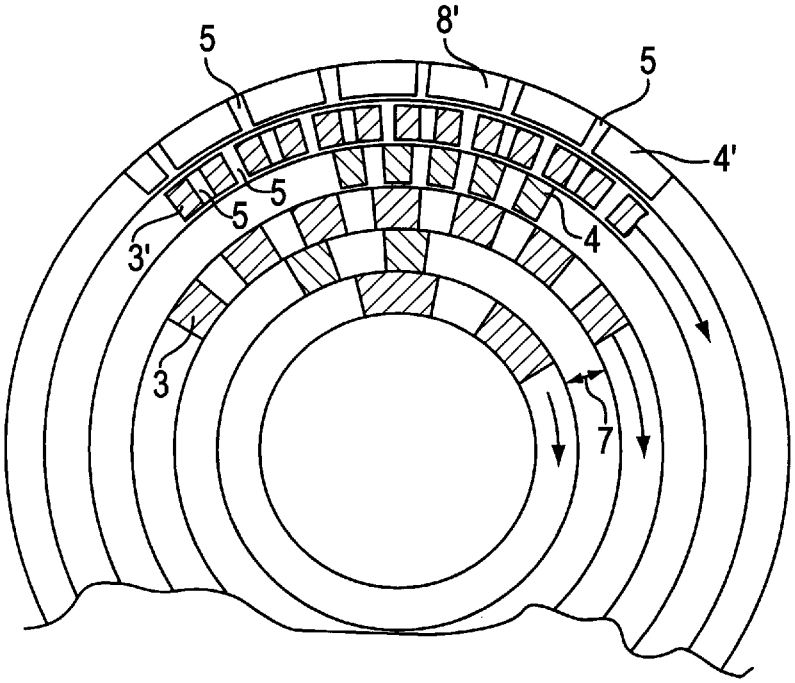
FIG. 2 shows a top view of the device.

As FIG. 2 shows, the apparatus is of such a kind that teeth disposed in an annular pattern respectively form a row of teeth and the row of teeth of one treatment tool reaches into the empty space 7 of the complementary tool. Adjacent teeth within the same toothed row may be connected to each other by intermediary pieces 8 or 8'. As shown in FIG. 1, the intermediary pieces 8, 8' may have an axial height H, H', respectively. The intermediary pieces 8, 8' also form a closed gap between adjacent teeth with an axial length L, L', respectively. It is noted, however, that it is not necessary that all adjacent teeth in a toothed row include an intermediary piece 8, 8', or that only closed gaps are utilized. That is, a toothed row may also include a combination of closed gaps formed by the intermediary pieces 8, 8' and open-ended gaps formed between adjacent teeth, with an associated axial gap length approximately the same as the axial height of the tooth. Thus, the present invention envisions treatment tools utilizing teeth which are axially longer and more stable than the teeth available in the prior art, for example, the axial height H, H' of the teeth 3, 3', 4, 4' may be between approximately 40 mm and 150 mm, the axial height H1, H1' of intermediary pieces 8, 8' may be between approximately 4 mm and 20 mm, the axial length of the closed gaps L, L' may be between approximately 40 mm and 150 mm, and the circumferential width of closed gaps L1, L1' may be between approximately 5 mm and 30 mm. Further, closed gaps may be formed such that the axial length of the closed gaps may be at least six times the circumferential width of the closed gaps.

FIG. 2 shows a top view of a device embodied according to the invention, wherein the teeth are represented in partial section. Only a part of the teeth that are available per se is depicted. The teeth are clearly disposed in concentric rows of teeth. The teeth 3 and 3' are affiliated with one treatment tool and the teeth 4 and 4' are affiliated with the other. In the depicted embodiment, the two radially outermost toothed rows, including teeth 3' and 4', each adjacent pair of teeth may be interconnected with intermediary piece 8, 8'. Because FIG. 2 depicts a sectional view of the treatment tools, the intermediary pieces are not shown, however, intermediary pieces 8, 8' may be visualized as positioned between adjacent teeth to close gaps 5. Alternatively, intermediary pieces 8, 8' may be an annular member for connecting a larger number of teeth within a toothed row. As noted above, the intermediary pieces may be positioned between each adjacent tooth in a toothed row, or alternatively, the toothed row may include adjacent teeth with an intermediary piece positioned therebetween and may also include adjacent teeth with an open-ended gap therebetween. The alternative arrangement of both closed and open-ended gaps is particularly advantageous in the toothed rows disposed on the radial outside of the treatment tools. Thus, for example, as shown in FIG. 2, the outermost toothed row comprising teeth 4' may include intermediary pieces in the spaces between teeth which are not labeled and may include gaps 5 which may be open-ended.

Figure 3A:
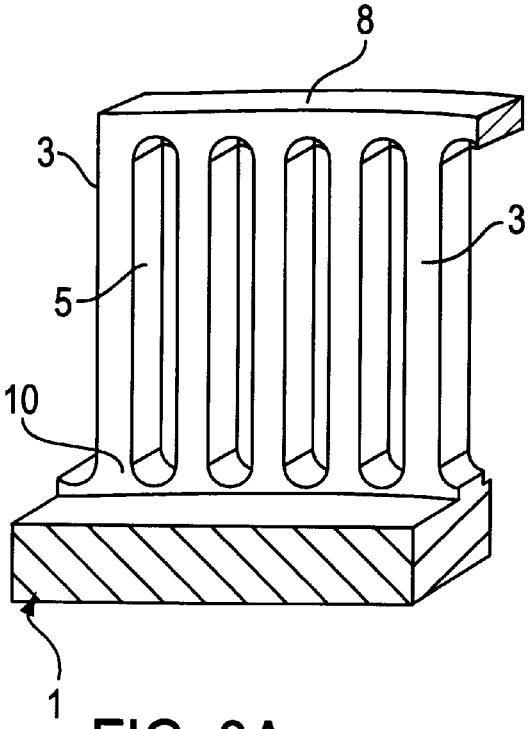
FIG. 3*a* shows a perspective representation of a part of the treatment tool.
Figure 3B:
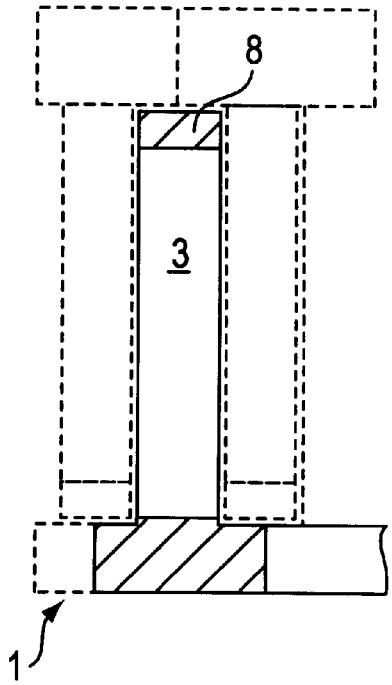
FIG. 3*b* shows a side view with regard to FIG. 3*a;*

For better explanation of the device, FIG. 3*a* shows a perspective drawing of an exemplary embodiment. The treatment tool 1, which is only shown partially, may include an annular toothed row comprising a plurality of teeth 3, in which each adjacent tooth is interconnected by the intermediary piece 8. The intermediary piece 8 forms a closed gap 5 between each adjacent tooth 3 in the toothed row sufficient to enable high consistency fibrous material to flow through. A side view of the embodiment shown in FIG. 3*a* is depicted in FIG. 3*b*, in schematic section. FIG. 3*b* shows treatment tool 1 and treatment tool 2 (in dashed lines), which are disposed engaged so that a proper use of the treatment device is possible. FIG. 3*b* also shows that each treatment tool may comprise a plurality of individual segments of circle or a ring. In accordance with the present invention, intermediary piece 8 may connect the teeth in any position between adjacent teeth that will enable mechanical stabilization of the teeth.

Figure 4:
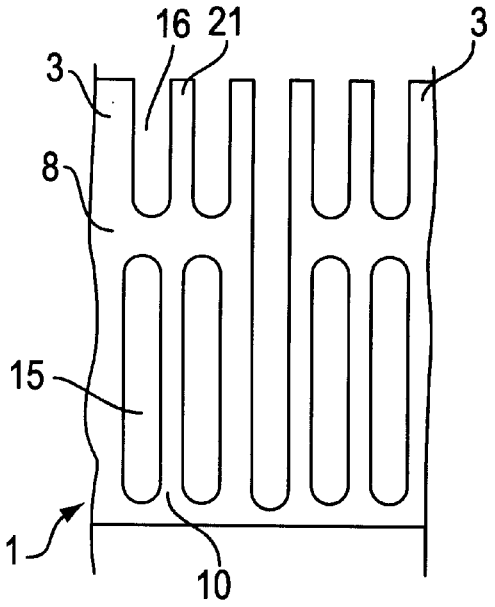
FIG. 4 shows a partial view of another embodiment of a treatment tool.
Figure 5:
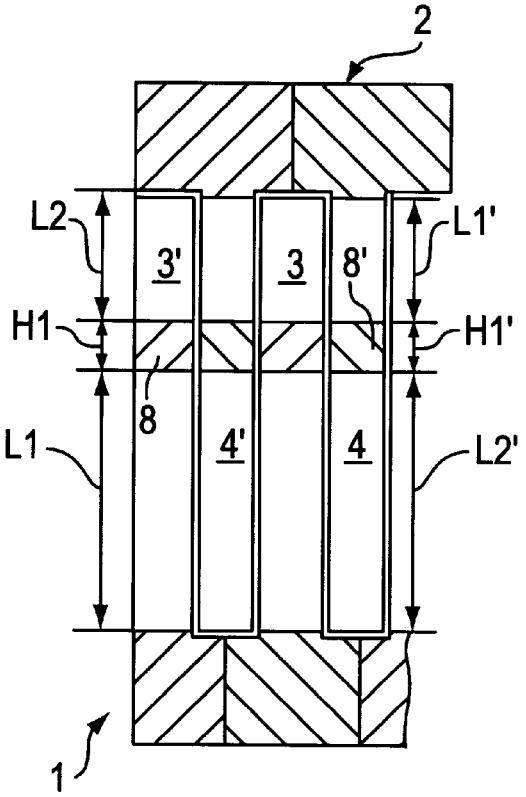
FIG. 5 shows the variant in FIG. 4, engaging with other treatment tools.

In the embodiment shown in FIG. 3*a*, intermediary piece 8 may be disposed at the outer tips of each tooth, however, other arrangements may be contemplated. For example, an alternative embodiment is shown in FIGS. 4 and 5. In FIG. 4, intermediary piece 8 may positioned between a tooth foot 10 and a tooth end 11, i.e., within the axial height of the tooth, and between adjacent teeth 3 to form both a closed gap 15 and an open-ended gap 16. For example, the present embodiment may contemplate an axial tooth height H, H' of between approximately 70–200 mm; a closed gap axial length L1, (L1') of between approximately 40–120 mm (20–60 mm); and an open-ended gap axial length L2, (L2') of between approximately 20–60 mm (80–120 mm); and an intermediary axial height H1, H1' of between approximately 5 mm and 20 mm.

In general, treatment tool 2, which cooperates with treatment tool 1, may be embodied similar to the treatment tool 1. However, it is noted that the treatment tools need not be identically embodied. The side view shown in FIG. 5, in schematic section, shows two treatment tools 1 and 2, which are disposed engaged so that a proper use of the treatment device is possible. FIG. 5 also shows that each treatment tool may comprise a plurality of individual segments of circle or a ring. Also as shown in FIG. 5, the treatment tools 1 and 2 may be configured such that the intermediary pieces 8 and 8' are positioned adjacent to each other so as to enable the greatest flow of treated fibrous material through the gaps and unwanted covering effect for the material flow passing through is minimized. Treatment tool 1, as shown in FIG. 5, may position intermediary piece 8, having an axial height H1, an axial distance L1 from the tooth foot. Thus, an open-ended gap with an axial length of L2, i.e., measured from the intermediary piece 8 to the tooth end, may be formed. Conversely, treatment tool 2, may position intermediary piece 8', having an axial height H1' (substantially equivalent to H), an axial distance L1' (substantially equivalent to L2) from the tooth foot. Thus, an open-ended gap with an axial length of L2' (substantially equivalent to L1), i.e., measured from the intermediary piece 8' to the tooth end, may be formed. While other embodiments may be contemplated from the present disclosure, the position and form of the intermediary pieces should be optimized with regard to strength and treatment technology.

Figure 6:
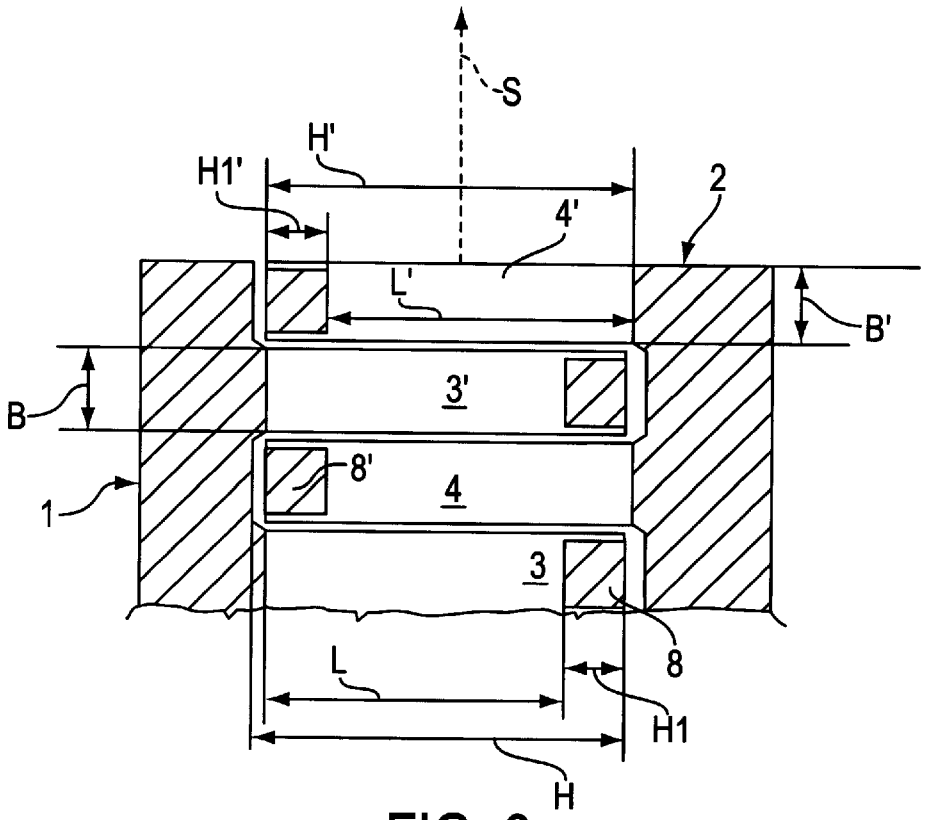
FIG. 6 shows a sectional side view of a variant.

FIG. 6 shows another alternative embodiment of the present invention. As shown in FIG. 6, each tooth 3, 3', 4, 4' in a toothed row may include a radial tooth width B or B'. As is also shown in FIG. 6, intermediary pieces 8 and 8' may not extend over the entire radial tooth width B or B', i.e., the radial width of intermediary 8 or 8' may be less than the radial tooth width. This alternative arrangement provides the treatment tools with a processing edge extending over the entire axial height H or H' of the teeth. Thus, the processing edge is longer and, which in many cases, more advantageous in high-consistency fibrous material treatment.

Figure 7:
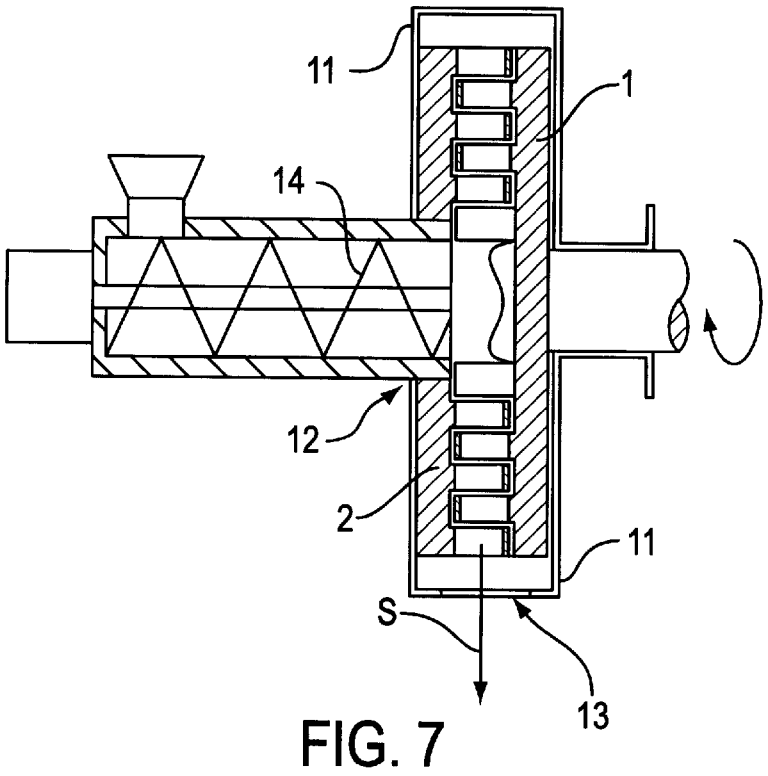
FIG. 7 shows a section through a treatment machine which contains the device.

FIG. 7 shows a treatment machine into which two treatment tools 1, 2 are inserted. A housing 11 essentially encompasses the treatment tools 1, 2 and has a supply opening 12 and an outlet opening 13, through which the fibrous material is to be supplied or discharged. At the supply opening 12, the machine has a feed device 14, which compresses the crumbly, high-consistency material so that a plug is produced. The fibrous material is conveyed between the treatment tools 1, 2, radially outward (arrow S) and then leaves the housing 11 through the outlet opening 13. The treatment machine may also include devices (not shown) for adding diluting water to the fibrous material as it is being conveyed toward the treatment tools 1 and 2.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for the mechanical treatment of high-consistency fibrous material including at least two treatment tools that can be moved in relation to each other, the at least two treatment tools each have a substantially rotationally symmetrical base body and are disposed coaxial to each other and comprise:

a plurality of fibrous material dispersing teeth disposed in annular rows concentric to centers of each of the treatment tools;

the plurality of fibrous material dispersing teeth including gaps disposed between adjacent teeth to form clear cross sections, the gaps enabling fibrous material to be treated to flow therethrough;

annular empty spaces positioned between the annular rows of teeth on each treatment tool;

the treatment tools engaging with one another such that at least one annular row of teeth of a first treatment tool is positioned within a corresponding annular empty space of a second treatment tool;

a connecting device that connects at least two adjacent teeth of a row and that forms at least a part of a closed gap comprising a closed cross section that can be flowed through radially; and a fibrous material compressing and feeding device coupled to an axis of the two treatment tools, wherein the fibrous material is compressed into a plug prior to being fed to the two treatment tools.

2. The device according to claim 1, the closed gap comprising an axial length between approximately 40 and 150 mm.

3. The device according to claim 1, the gaps comprising a circumferential width between approximately 5 and 30 mm.

4. The device according to claim 1, the closed gap comprising an axial length and a circumferential width, the axial length being at least six times the circumferential width.

5. The device according to claim 1, the connecting device comprising an intermediary piece rigidly connected to respective tips of the adjacent teeth.

6. The device according to claim 1, the connecting device comprising an intermediary piece disposed between the adjacent teeth to form the closed gap and an open-ended gap.

7. The device according to claim 6, the closed gap is approximately equal to the open-ended gap.

8. The device according to claim 7, the connecting device comprising an axial height between approximately 4 and 20 mm.

9. The device according to claims 6, wherein in adjacent rows of teeth of complementary treatment tools, the intermediary piece of one treatment tool is disposed radially adjacent the intermediary piece of the complementary treatment tool.

10. The device according to claim 1, the rotationally symmetrical base body contains a plurality of concentric rows of teeth disposed radial to one another and two adjacent treatment tools, which can be moved in relation to each other, disposed axially adjacent to each other. tool.

11. The device according to claim 1, the connecting member comprising an intermediary piece for connecting each tooth in said row.

12. The device according to claim 1, each tooth comprising a radial tooth width and the connecting member comprising an intermediary piece having a radial piece width less than the radial tooth width.

13. The device according to claim 1, the at least two treatment tools comprising one of individual segments of a circle and of a ring.

14. The device according to claim 1, the at least two treatment tools produced in one of a casting and an injection process.

15. The device according to claim 1 further comprising:

a housing with at least one supply opening and at least one outlet opening, the housing essentially encompassing the first and second treatment tools; and the compressing and feeding device being coupled to the supply opening.

16. The treatment machine according to claim 15, the outlet opening includes a fall shaft for the treated high-consistency fibrous material.

17. The treatment machine according to claim 15, further comprising devices positioned upstream from the treatment tools for adding water for the treated, high-consistency fibrous material.

18. A device for mechanically treating a high-consistency fibrous material comprising:

first and second fibrous material treatment tools, said first and second fibrous material treatment tools mounted for relative rotation;

each fibrous material treatment tool comprising a plurality of annular toothed rows, each said annular toothed row comprising a plurality of teeth and an adjacent gap between each of said plurality of teeth; and at least one intermediary piece connecting adjacent teeth to form a closed gap, the closed gap enabling the fibrous material to move through said device;and a fibrous material compressing and feeding device coupled to an axis of the two treatment tools, wherein the fibrous material is compressed into a plug prior to being fed to the two treatment tools.

19. The device according to claim 18, each of said plurality of teeth comprising a tooth foot positioned adjacent a corresponding treatment tool and a tooth edge positioned opposite said tooth foot.

20. The device according to claim 19, said at least one intermediary piece positioned between the tooth edges of adjacent teeth.

21. The device according to claim 20, said intermediary device comprising a single piece that connects each adjacent tooth in at least one of said plurality of annular rows.

22. The device according to claim 19, said intermediary piece further forming an open-ended gap.

23. The device according to claim 19, said at least one intermediary piece positioned between the tooth edges and the tooth feet of said adjacent teeth.

24. The device according to claim 19, each of said first and second fibrous material treatment tools further comprising an annular space between each adjacent annular row;

said fibrous material treatment tools mounted such that said plurality of annular rows of the first treatment tool extend into respective annular spaces of said second fibrous material treatment tool; and said fibrous material treatment tools mounted such that said plurality of annular rows of the second fibrous material treatment tool extend into respective annular spaces of said first fibrous material treatment tool.

25. The device according to claim 24, said at least one intermediary piece comprising a first intermediary piece between the tooth edges and the tooth feet of adjacent teeth of said first fibrous material treatment tool and a second intermediary piece between the tooth edges and the tooth feet of adjacent teeth of said second fibrous material treatment tool.

26. The device according to claim 25, said first and second intermediary pieces are rotatable within a same plane between said first and second fibrous material treatment tools.

27. The device according to claim 18, each of said plurality of teeth comprising a radial tooth width and said intermediary pieces comprising a radial piece width.

28. The device according to claim 27, said radial tooth width being greater than said radial piece width.

* * * * *

UNITED STATES PATENT AND TRADEMARK OFFICE

CERTIFICATE OF CORRECTION

PATENT NO. : 5,904,308

DATED : May 18, 1999

INVENTOR(S) : Hans SCHNELL

It is certified that error appears in the above-identified patent and that said Letters Patent is hereby corrected as shown below:

In Column 8, Line 2, change "coupled to" to —coupled along—.

In Column 9, Line 7, change "coupled to" to —coupled along—.

Signed and Sealed this

Fourteenth Day of September, 1999

*Attest:*

*Attesting Officer*

Q. TODD DICKINSON

*Acting Commissioner of Patents and Trademarks*